US012352067B2

(12) United States Patent
Fischmann

(10) Patent No.: US 12,352,067 B2
(45) Date of Patent: Jul. 8, 2025

(54) URBAN PERFORMANCE VENUE FOR THE PROVISION OF ENTERTAINMENT TO AN AUDIENCE IN A BEACH THEMED SETTING

(71) Applicant: CRYSTAL LAGOONS TECHNOLOGIES, Inc., Wilmington, DE (US)

(72) Inventor: Fernando Benjamin Fischmann, Las Condes Santiago (CL)

(73) Assignee: Crystal Lagoons Technologies, Inc., Miami, FL (US)

( * ) Notice: Subject to any disclaimer, the term of this patent is extended or adjusted under 35 U.S.C. 154(b) by 0 days.

(21) Appl. No.: 16/726,011

(22) Filed: Dec. 23, 2019

(65) Prior Publication Data

US 2020/0208423 A1 Jul. 2, 2020

Related U.S. Application Data

(63) Continuation-in-part of application No. 16/538,273, filed on Aug. 12, 2019, now Pat. No. 10,724,260.
(Continued)

(51) Int. Cl.
*E04H 3/12* (2006.01)
*E04H 3/22* (2006.01)

(52) U.S. Cl.
CPC ..... *E04H 3/12* (2013.01); *E04H 3/22* (2013.01)

(58) Field of Classification Search
CPC .... E04H 3/12; E04H 4/00; E04H 3/22; E04H 4/148; E04B 1/342
(Continued)

(56) References Cited

U.S. PATENT DOCUMENTS 483,600 A 10/1892 Butler
1,657,598 A 1/1928 Whitman
(Continued)

FOREIGN PATENT DOCUMENTS

CN 1214402 A 4/1999
CN 1367300 A 9/2002
(Continued)

OTHER PUBLICATIONS

URBNSurf <urbnsurf.com/parkoverview>, accessed 2020 (Year: 2020).*
(Continued)

*Primary Examiner* — Brent W Herring
(74) *Attorney, Agent, or Firm* — Merchant & Gould P.C.

(57) ABSTRACT

An urban performance venue having a waterfront setting for providing entertainment to an audience is disclosed. The venue includes a performances surface that includes a reference point located substantially in its center. A first spectator area is located closer to the performances surface, is substantially covered with a sandy material, and has an elevation angle not higher than 10° with respect to the performances surface. A second spectator area is located farther from the performances surface, has an elevation angle of at least 30° and extends over at least a 90° reference angle view from the reference point. A man-made clear lagoon extends from a side of the performances surface away from the spectator area, partially surrounds the performances area, and is arranged and configured to resemble a portion of a tropical sea. Wherein the line of sight from a spectator includes views of the performances surface and the lagoon.

25 Claims, 6 Drawing Sheets

Related U.S. Application Data

(60) Provisional application No. 62/785,086, filed on Dec. 26, 2018.

(58) Field of Classification Search
USPC ..... 52/6, 8, 9, 10
See application file for complete search history.

(56) References Cited

U.S. PATENT DOCUMENTS

| | | | | |
|---|---|---|---|---|
| 2,071,520 | A | 2/1937 | Harrison | |
| 3,596,996 | A | 8/1971 | Carter | |
| 3,673,751 | A | 7/1972 | Boassy et al. | |
| 3,695,434 | A | 10/1972 | Whitten, Jr. | |
| 3,739,539 | A | 6/1973 | Posnick | |
| 3,823,690 | A | 7/1974 | Rynberk | |
| 3,832,814 | A | 9/1974 | Teschner | |
| 3,990,250 | A | 11/1976 | Howard | |
| 4,263,759 | A | 4/1981 | Miller | |
| 4,686,799 | A | 8/1987 | Kwake | |
| 4,843,658 | A | 7/1989 | Hodak | |
| 4,976,088 | A | 12/1990 | Powers | |
| 5,139,853 | A | 8/1992 | Mathieson et al. | |
| 5,143,623 | A | 9/1992 | Kroll | |
| 5,800,272 | A | 9/1998 | Pons | |
| 6,168,532 | B1 * | 1/2001 | McCaffrey | E01C 13/083 472/92 |
| 6,317,901 | B1 | 11/2001 | Corpuel | |
| 6,764,139 | B1 | 7/2004 | Wortman | |
| 7,036,449 | B2 | 5/2006 | Sutter | |
| 7,717,569 | B2 | 5/2010 | Sokeila et al. | |
| 7,820,055 | B2 | 10/2010 | Fischmann Torres | |
| 8,062,514 | B2 | 11/2011 | Fischmann Torres | |
| 8,070,942 | B2 | 12/2011 | Fischmann Torres | |
| 8,347,556 | B2 * | 1/2013 | Stelmaszek | E04H 3/12 104/53 |
| 8,454,838 | B2 | 6/2013 | Fischmann T. | |
| 8,465,651 | B2 | 6/2013 | Fischmann T. | |
| 8,518,269 | B2 | 8/2013 | Fischmann T. | |
| 8,544,220 | B2 | 10/2013 | Milani | |
| 8,555,557 | B2 * | 10/2013 | Hosking | E04B 7/105 52/66 |
| 8,753,520 | B1 | 6/2014 | Fischmann | |
| 8,790,518 | B2 | 7/2014 | Fischmann Torres | |
| 9,051,193 | B2 | 6/2015 | Fischmann T. | |
| 9,062,471 | B2 | 6/2015 | Fischmann T. | |
| 9,080,342 | B2 | 7/2015 | Fischmann T. | |
| 9,470,007 | B2 | 10/2016 | Fischmann Torres | |
| 9,470,008 | B2 | 10/2016 | Fischmann | |
| 9,708,822 | B2 | 7/2017 | Fischmann Torres | |
| 9,920,498 | B2 | 3/2018 | Fischmann | |
| 9,957,693 | B2 | 5/2018 | Fischmann Torres et al. | |
| 10,072,430 | B2 | 9/2018 | Nasibov | |
| 10,358,837 | B2 | 7/2019 | Khamis et al. | |
| 10,428,542 | B1 | 10/2019 | Jackson et al. | |
| 10,472,839 | B2 | 11/2019 | Khamis et al. | |
| 10,486,074 | B2 | 11/2019 | Fischmann | |
| 10,521,870 | B2 * | 12/2019 | Fischmann | E04H 4/0006 |
| 10,724,260 | B2 | 7/2020 | Fischmann | |
| 10,982,400 | B2 | 4/2021 | Rodriguez Larreta et al. | |
| 10,994,215 | B2 | 5/2021 | Fischmann | |
| 10,997,683 | B2 | 5/2021 | Fischmann | |
| 10,997,684 | B2 | 5/2021 | Fischmann | |
| 11,015,333 | B2 | 5/2021 | Fischmann | |
| 11,098,495 | B2 | 8/2021 | Fischmann | |
| 11,123,645 | B2 | 9/2021 | Fischmann | |
| 11,132,663 | B2 | 9/2021 | Fischmann | |
| 11,167,218 | B2 | 11/2021 | Fischmann | |
| 11,186,981 | B2 | 11/2021 | Fischmann | |
| 11,250,533 | B2 | 2/2022 | Fischmann | |
| 11,270,400 | B2 | 3/2022 | Fischmann | |
| 11,280,099 | B2 | 3/2022 | Fischmann | |
| 11,669,929 | B2 | 6/2023 | Fischmann | |
| 11,732,493 | B2 | 8/2023 | Fischmann | |
| 2001/0018370 | A1 | 8/2001 | Arie | |
| 2003/0228195 | A1 | 12/2003 | Mizutani | |
| 2007/0181498 | A1 | 8/2007 | Kaas | |
| 2007/0196173 | A1 | 8/2007 | Shehan | |
| 2007/0248414 | A1 | 10/2007 | Fratianni | |
| 2008/0021776 | A1 | 1/2008 | Lochtefeld | |
| 2008/0116142 | A1 | 5/2008 | Fischmann Torres | |
| 2008/0127574 | A1 * | 6/2008 | Yi | E04H 3/02 52/8 |
| 2010/0146869 | A1 * | 6/2010 | Stelmaszek | G06Q 99/00 52/9 |
| 2011/0108490 | A1 | 5/2011 | Fischmann Torres | |
| 2012/0024796 | A1 | 2/2012 | Fischmann T. | |
| 2012/0061967 | A1 | 3/2012 | Chaganti et al. | |
| 2012/0102874 | A1 | 5/2012 | Milani | |
| 2012/0131861 | A1 * | 5/2012 | Hosking | E04B 7/105 52/8 |
| 2012/0255113 | A1 | 10/2012 | Osterman et al. | |
| 2012/0291193 | A1 | 11/2012 | Panchal | |
| 2013/0074254 | A1 | 3/2013 | Payne et al. | |
| 2014/0228138 | A1 | 8/2014 | Scott | |
| 2015/0125212 | A1 | 5/2015 | Fischmann | |
| 2015/0166361 | A1 | 6/2015 | Fischmann | |
| 2015/0240506 | A1 * | 8/2015 | Ruhmann | E04H 3/30 52/8 |
| 2016/0177586 | A1 | 6/2016 | Nasibov | |
| 2019/0169867 | A1 | 6/2019 | Khamis et al. | |
| 2019/0169870 | A1 | 6/2019 | Khamis et al. | |
| 2019/0232180 | A1 | 8/2019 | Fischmann | |
| 2019/0236744 | A1 * | 8/2019 | Fischmann | C02F 1/004 |
| 2019/0355083 | A1 * | 11/2019 | Fischmann | E04B 1/342 |
| 2020/0023281 | A1 * | 1/2020 | Fischmann | G06Q 10/00 |
| 2020/0023282 | A1 | 1/2020 | Fischmann | |
| 2020/0027186 | A1 * | 1/2020 | Fischmann | E04B 1/342 |
| 2020/0032502 | A1 * | 1/2020 | Fischmann | E04H 3/02 |
| 2020/0032503 | A1 * | 1/2020 | Fischmann | C02F 1/004 |
| 2020/0047076 | A1 | 2/2020 | Fischmann | |
| 2020/0051057 | A1 * | 2/2020 | Fischmann | E04H 4/148 |
| 2020/0074577 | A1 * | 3/2020 | Fischmann | E04H 4/0006 |
| 2020/0074579 | A1 | 3/2020 | Fischmann | |
| 2020/0208424 | A1 | 7/2020 | Fishmann | |
| 2020/0208425 | A1 | 7/2020 | Fischmann | |
| 2020/0283979 | A1 | 9/2020 | Gomes de Oliveira et al. | |
| 2022/0170281 | A1 | 6/2022 | Fischmann | |
| 2022/0178159 | A1 | 6/2022 | Casadio | |
| 2022/0188960 | A1 | 6/2022 | Fischmann | |
| 2023/0047399 | A1 | 2/2023 | Fischmann | |
| 2023/0057876 | A1 | 2/2023 | Fischmann | |
| 2023/0058612 | A1 | 2/2023 | Fischmann | |

FOREIGN PATENT DOCUMENTS

| | | | |
|---|---|---|---|
| CN | 1865631 | A | 11/2006 |
| EP | 1 561 495 | A1 | 8/2005 |
| JP | 2002-309539 | A | 10/2002 |
| WO | 2006/116745 | A2 | 11/2006 |
| WO | 2020/139864 | A1 | 7/2020 |

OTHER PUBLICATIONS

Gameng, Monica, Construction of URBNSURF Melbourne to support 300 jobs, <https://blog.plantminer.com.au/construction-of-urbnsurf-melbourne-to-support-300-jobs>, Feb. 23, 2018 (Year: 2018).*

Baskas, Harriet, Surf's Up At Munich Airport, <https://stuckattheairport.com/2014/07/12/surfs-up-at-munich-airport-2/> (Year: 2014).*

Pitz, Taylor, Huntington Beach Responds with Reforms for US Open of Surfing 2014, <https://www.theinertia.com/surf/the-us-open-of-surfing-2014/>, referred to herein as "Huntington Beach Surf Comp" (Year: 2013).*

URBNSurf Youtube video, <https://www.youtube.com/watch?time_continue=64&v=tH2MLBdea5g&feature=emb_logo>, published Feb. 21, 2018 (Year: 2018).*

Beaches Negril, Resort by Sandals <https://www.beaches.com/resorts/negril/maps/>, accessed 2020 (Year: 2020).*

Rentafloat by Europonton GmbH <https://www.rentafloat.eu/en/pontoon-systems/floating-stages> (Year: 2017).*

Walk On Water: Over Pool Flooring Systems <https://web.archive.org/web/20171216162429/http://walkonwaterentertainment.com/> (Year: 2017).*

(56) References Cited

OTHER PUBLICATIONS

Valera, 12 Incredible Artificial and Man-Made Beaches, The Weather Channel (Year: 2017).*
Surfing at URBNSURF, empireave.com (Year: 2019).*
Lev-Tov, Devorah, 8 of the most amazing sand-bottom pools in the world, Monte Carlo Bay Hotel & Resort (Year: 2021).*
IHG Hotels & Resorts, Dive In!, Crowne Plaza Jordan—Dead Sea Resort & Spa (Year: 2022).*
Instagram Post, Account: @crowneplazadeadsea, pool photo (Year: 2016).*
Metro Lagoons, <metrolagoons.com>, accessed Mar. 11, 2025 (Year: 2025).*
Messynessy, The Greatest Open Air (and floating) Show on Earth, Apr. 23, 2021 (Year: 2021).*
Locke, Welcome Lake Compounce, accessed Mar. 11, 2025 (Year: 2025).*
International Search Report and Written Opinion for Application No. PCT/US19/68414 mailed Apr. 1, 2020.
"Public Access Lagoons" (Crystal Lagoons) retrieved from https://web.archive.org/web/20180727155828/https://www.crystal-lagoons.com/public-access-lagoons/>, 1 page (Jul. 27, 2018).
International Search Report and Written Opinion for Application No. PCT/US19/68410 mailed Mar. 24, 2020.
Daytona International Speedway, Wikipedia, https://web.archive.org/web/20180912065408/https://en.wikipedia. org/ wiki/Daytona_International_ Speedway, 14 pages (Sep. 9, 2018).
Six Flags Great America, Wikipedia, https://en.wikipedia.org/wiki/Six_Flags_Great_America, 26 pages (Feb. 18, 2020).
Six Flags Great America, https://www.sixflags.com/greatamerica/attractions/water-park-rides, 1 page (Dec. 16, 2018).
International Search Report and Written Opinion for Application No. PCT/US2019/06841 mailed Mar. 4, 2020.
Crystal Lagoons, Crystal Lagoons at Epperson Groundbreaking with Review Masterplan, https://www.youtube.com/watch?v=U6ev1uFZ8XM, 2 pages (Jul. 25, 2017).
Jamindan, Blue Oyzer Cult Santa Cruz CA Boardwalk, https://www.youtube.com/watch?v=XScGHOPS8g0, 2 pages (Aug. 25, 2012).
International Search Report and Written Opinion for Application No. PCT/IB19/00919 mailed Feb. 12, 2020.
Beaches Negril, Beaches Resorts by Sandals <https://www.beaches.com/resorts/negril/mas/> (2020).
URBNSURF, "Welcome To URBNSURF". Retrieved from the Internet: <URL:https://www.facebook.com/urbnsurf/videos/1773008676245450/>, published on Facebook on Jun. 8, 2016, 2 pages.
Busbee, Jay, The wild, weird stories of Lake Lloyd at Daytona International Speedway, <https://sports.yahoo.com/blogs/ nascar-from-the-marbles/the-wild—weird-stories-of-lake-lloyd-at-daytona-international-speedway-220533641.html> (Year: 2015).
Martinelli, Michelle, Why NASCAR's Daytona track has its own massive lake, <https://ftw.usatoday.com/2019/02/nascar-daytona-500-lake-lloyd-truex-bowyer> (Year: 2019).
Maps, Daytona International Speedway, <https://www.daytonainternationalspeedway.com/Plan-Your-Visit/Maps.aspx> (Year: 2020).
Geico Camping, <https ://www .daytonainternationalspeedway.com/Events/2019/Circle-K-Firecracker-250/GE I Co-Camping .aspx> ( Year: 2020).
Challenge Daytona,<https://challenge-daytona.com/challengedaytona-swim/> (Year: 2020).
International Search Report and Written Opinion for Application No. PCT/IB2018/001089 mailed Jan. 17, 2019.
International Search Report and Written Opinion for Application No. PCT/IB2018/001084 mailed Jan. 29, 2019.
"Treasure Bay Bintan" [online] Retrieved from the Internet: <URL: https://www.treasurebaybintan.com>, copyright 2016, 12 pages.

* cited by examiner

URBAN PERFORMANCE VENUE FOR THE PROVISION OF ENTERTAINMENT TO AN AUDIENCE IN A BEACH THEMED SETTING

This application is a Continuation-in-Part of U.S. patent application Ser. No. 16/538,273, filed Aug. 12, 2019, which claims benefit of U.S. Provisional Ser. No. 62/785,086, filed Dec. 26, 2018 and which applications are incorporated herein by reference. To the extent appropriate, a claim of priority is made to each of the above disclosed applications.

FIELD OF THE INVENTION

The present invention relates to an urban performances venue that is configured to provide entertainment to an audience attending to a performance display by creating a beach themed setting with a tropical-style lagoon that surrounds the performance display and that allows to provide flexibility and extend the use and activities to be performed in such performance venue compared to conventional venues.

BACKGROUND

The music market has been constantly changing, as years ago music was only available through the radio and physical copies of CDs for example, whereas advances in technology have resulted in current trends of digital music downloads and piracy, considerably reducing the ability to sell music.

Therefore, given these new trends in the music market, with easy digital downloads and high piracy, artists have turned into the growing market of live shows and concerts, creating a high demand for venues that are able to host these types of events. In general, venues for holding large events vary in type, size, and layout, and can be classified as either closed or open venues.

However, given this considerable increase in demand for live shows, a large portion of these shows are held in locations and venues that are not prepared for these uses.

For example, live shows are held in venues such as large stadiums where the stage is placed in the middle flat area of the stadium and therefore a large number of spectators end up being far away from the stage not having the proper acoustics or proper view for spectators either in flat areas with no slope that results in poor visibility, or either seated in the bleachers with side views that are also not desirable for watching a live show. In addition, stadiums are not known as being cozy or beautiful environments, being perceived as large artificial structures that are less attractive to younger masses.

Another example of large shows being held on venues not prepared for such uses corresponds to venues such as parks that are not designed for these purposes and do not have the necessary infrastructure for these types of events, generating problems such as poor visibility and acoustics and limited areas for spectators, among others. Due to the use of large flat areas, spectators that are farther from the stage may not have the proper visibility angle to see it.

The use and implementation of venues with new and innovative configurations, such as amphitheaters, has the ability of offering a broader range of possibilities to attendees, but they also carry additional difficulties. The use of amphitheaters has generally been limited to the occurrence of events, festivals or screenings, without having other uses when such events are not taking place. Therefore, there is considerable loss of space that could be used for other purposes while no events in the amphitheater venue are occurring. In addition, aesthetic configurations and features of amphitheaters have generally focused on the stage or screen, with not much focus on the surroundings of the venue. As mentioned above, while most people attend to a show with a specific aim to see or buy, they get greater pleasure in discovering something new, being the main event often only the pretext for the real purpose which is to socialize and share experiences with family and friends in an appealing atmosphere.

There are no venue configurations that have resolved the above issues and that are able to provide an urban beach tropical style setting in addition to having the proper infrastructure for large events. It is known that most people consider a very attractive experience to spend time in the vicinity of a water body such as a river, a lake, a pool, a beach or the like, which is even more attractive when the water body is or resembles a tropical lagoon, such as in the Caribbean which are known to have calm and clear turquoise waters, but, thy are generally located away from urban areas and are not affordable for a significant part of the population.

The scarcity of venues offering a performance space and located in the immediate vicinity of water bodies featuring calm and clear turquoise waters, combined with the fact that such water bodies are usually away from urban areas and therefore cannot attract a high amount of visitors on a permanent basis, takes away the possibility for spectators to enjoy an entertainment display surrounded by a waterfront themed setting.

There are no performance venues that can bring many people together to enjoy a performance display and at the same time experience a waterfront environment, such as an idyllic and urban beach environment with an expanse of crystal clear turquoise water as a backdrop, which can take it to the next level.

SUMMARY

The present invention addresses the above technical limitations, by providing an urban performance venue allocated in the immediate vicinity of a man-made crystal clear lagoon by creating an urban beach themed setting with a tropical style lagoon that surrounds an entertainment display and which can be used on a year-round basis in many activities such as providing beach life, allowing the practice of water sports, allowing to have waterfront walks, and providing lifestyle such as having restaurants and bars near the lagoon, provide competitions inside or outside the lagoon, providing space for other relaxation or sport activities, and a gathering place for families and friends, among others.

According to one aspect of the invention, there is provided an urban performance venue for the provision of entertainment to an audience in a waterfront urban beach-like themed setting. The venue includes a performances surface arranged for optimal spectator viewing from a spectator area, the performances surface having a front side and a rear side, wherein the performances surface includes a reference point located substantially in its center, and wherein the performance surface can comprise a display means. A spectator area comprising seating and standing locations and extending from the front side of the performances surface is also provided, wherein the spectator area comprises a first spectator area located closer to the performances surface and preferably substantially covered with a sandy material resembling a tropical style beach and a second spectator area located farther from the performances surface, wherein both first and second spectator areas are configured to be positioned in different elevations. The first spectator area has an elevation angle not higher than 10° with respect to the performances surface and the second spectator area has an elevation angle of at least 30° with respect to the performances surface. The second spectator area extends over a surface that covers a point within at least a 90° reference angle view from the reference point which defines the optimal boundaries of the second spectator area. A man-made crystal clear lagoon extends from a side of the performances surface in a substantially opposite direction to the spectator area, the man-made crystal clear lagoon has a bottom, an edge and a surface arranged and configured to resemble a portion of a tropical sea. The man-made crystal clear lagoon preferably at least partially surrounds the performances area. The configuration of the foregoing elements is such that a line of sight from a spectator on the second spectator area and from the first spectator area has views of the performances surface and the man-made crystal clear lagoon 3 create an urban beach themed performance venue and setting.

These and other variations of the invention will become apparent to those skilled in the art upon a more detailed description of the invention. The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

DESCRIPTION OF THE FIGURES

Referring to the drawings, wherein like numerals represent like parts throughout the several views.

DETAILED DESCRIPTION OF THE INVENTION

Figure 1:
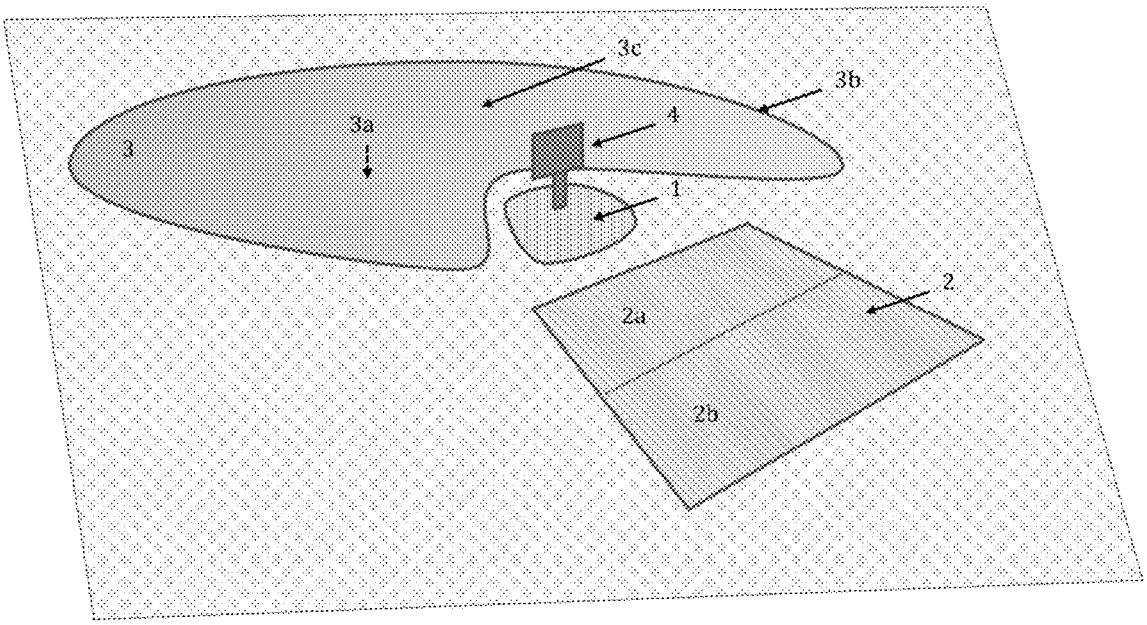
FIG. 1 shows an aerial angle view of an embodiment of the invention, where the crystal clear lagoon (3) is seen surrounding the performances surface (1), and the spectator area (2) comprises a first spectator area (2*a*) and a second spectator area (2*b*). The crystal clear lagoon (3) comprises a bottom of the lagoon (3*a*), a surface of the lagoon (3*b*) and an edge of the lagoon (3*c*). In this embodiment, the performances surface (1) includes a display means (4) such as a screen.
Figure 2:
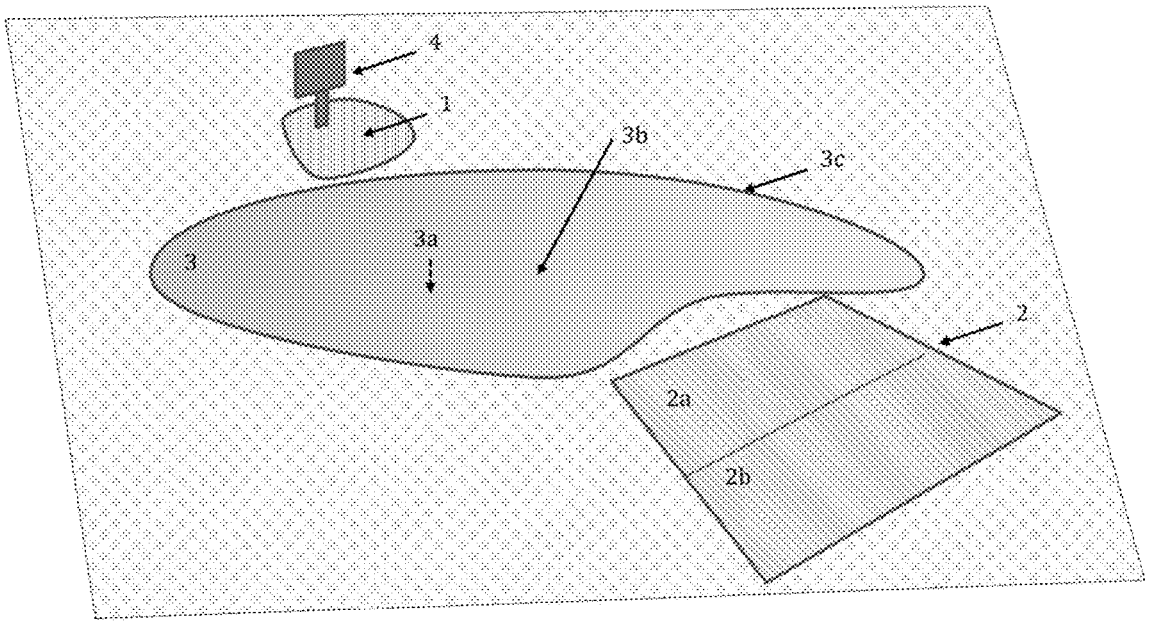
FIG. 2 shows an aerial angle view of an embodiment of the invention, where the crystal clear lagoon (3) is seen located in between the performances surface (1) and the spectator area (2). The spectator area (2) comprises a first spectator area (2*a*) and a second spectator area (2*b*). The crystal clear lagoon (3) comprises a bottom of the lagoon (3*a*), a surface of the lagoon (3*b*) and an edge of the lagoon (3*c*). In this embodiment, the performances surface (1) includes a display means (4) such as a screen.
Figure 3:
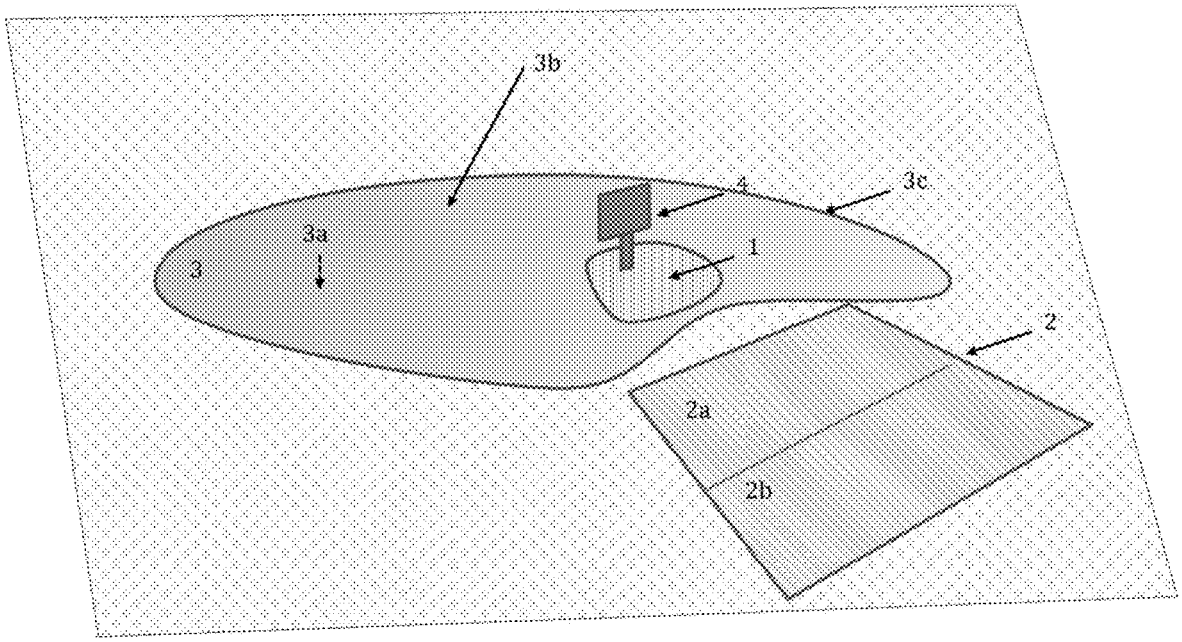
FIG. 3 shows an aerial angle view of an embodiment of the invention, where the crystal clear lagoon (3) is seen located in front of the spectator area (2), and the performances surface is an island or floating structure located within the lagoon (3). The spectator area (2) comprises a first spectator area (2*a*) and a second spectator area (2*b*). The crystal clear lagoon (3) comprises a bottom of the lagoon (3*a*), a surface of the lagoon (3*b*) and an edge of the lagoon (3*c*). In this embodiment, the performances surface (1) includes a display means (4) such as a screen.
Figure 4:
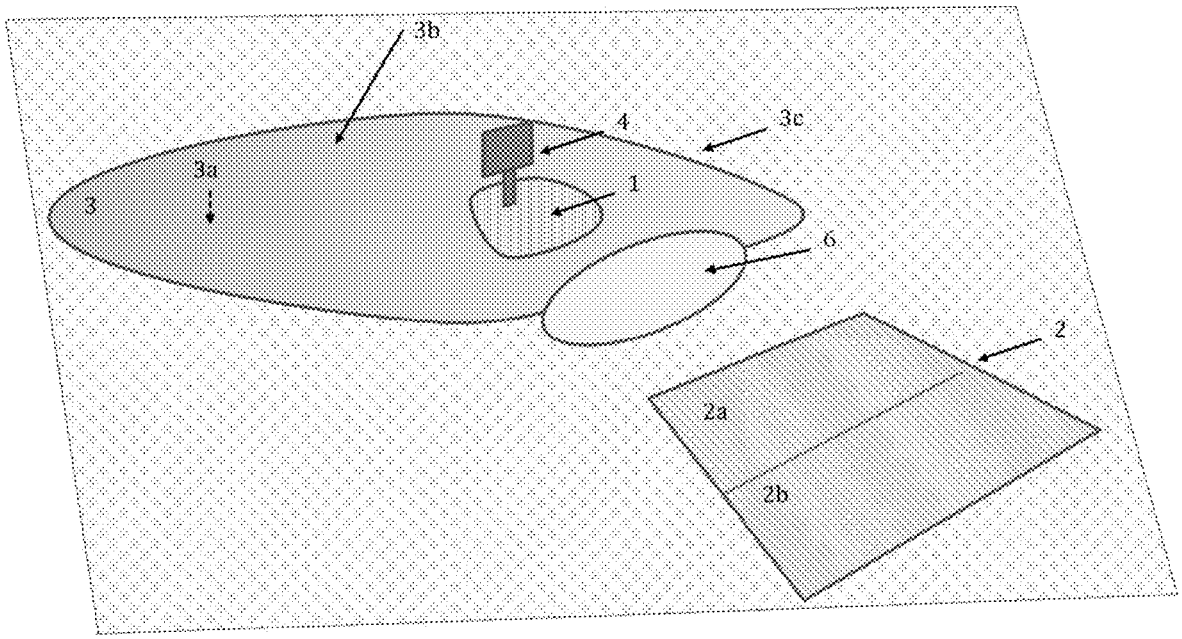
FIG. 4 shows an aerial angle view of an embodiment of the invention, where the crystal clear lagoon (3) is seen located in front of spectator area (2), and in between there is a conventional swimming pool (6) that complements the spectator area. In this embodiment, the performances surface is an island or a floating structure located within the lagoon (3). The spectator area (2) comprises a first spectator area (2*a*) and a second spectator area (2*b*). The crystal clear lagoon (3) comprises a bottom of the lagoon (3*a*), a surface of the lagoon (3*b*) and an edge of the lagoon (3*c*). In this embodiment, the performances surface (1) includes a display means (6) such as a screen.
Figure 5:
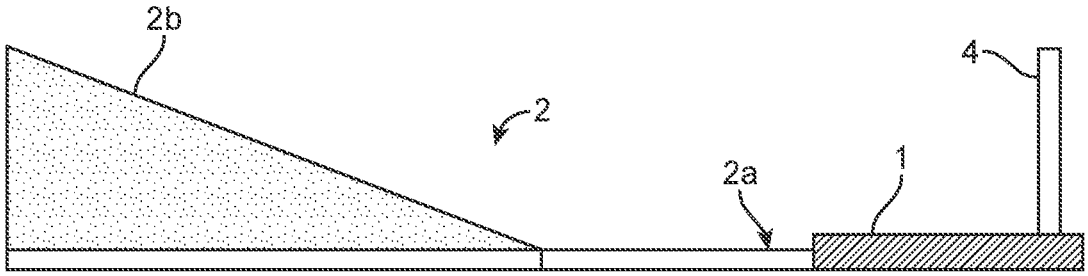
FIG. 5 shows a side schematic view of an embodiment of the invention wherein the performances surface (1) comprises a display means (4) such as a screen, and is then at least partially surrounded by the first spectator area (2*a*) and then with the second spectator area (2*b*).
Figure 6:
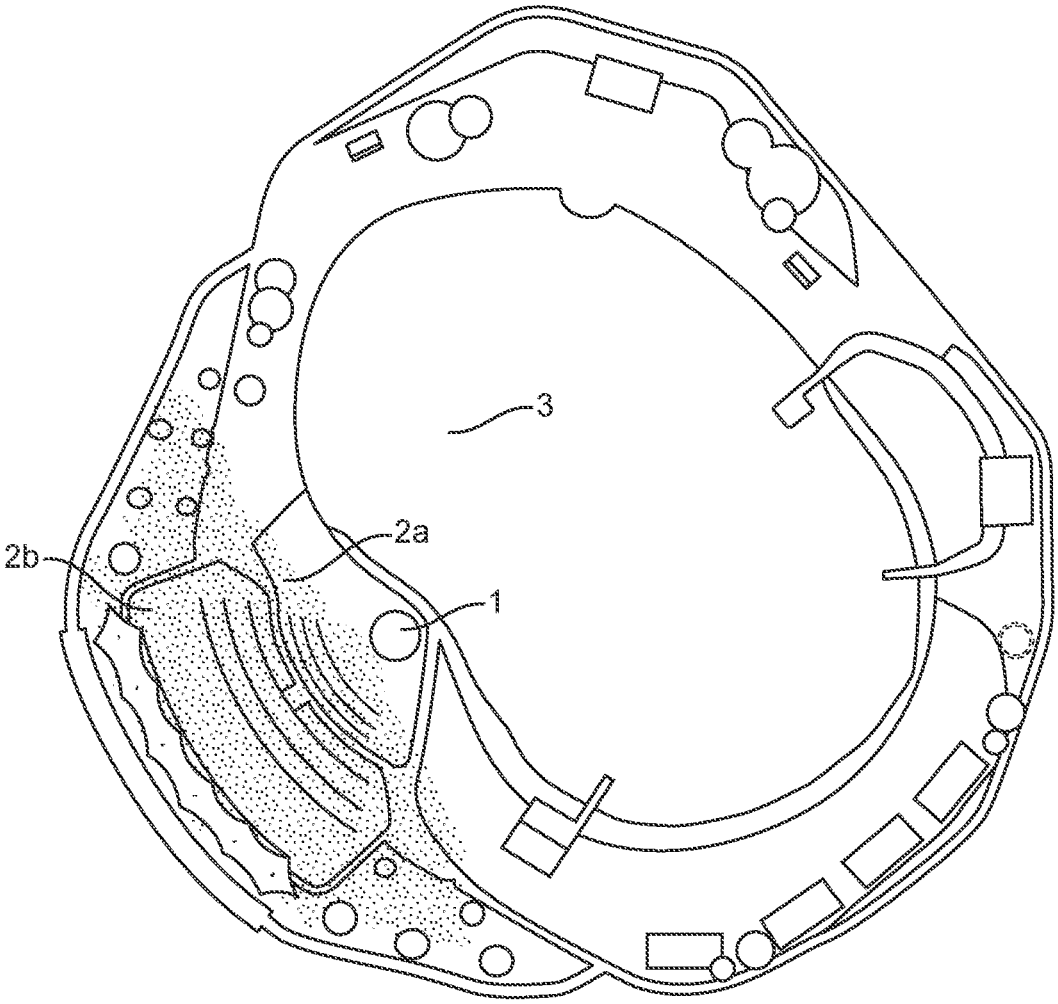
FIG. 6 shows a top view of an embodiment of the invention, wherein the performances surface (1) is located next to the crystal clear lagoon (3), and has a surrounding spectator area (2) with an adjacent first spectator area (2*a*) that comprises sand and a farther second spectator area (2*b*) with grass and green areas.
Figure 7:
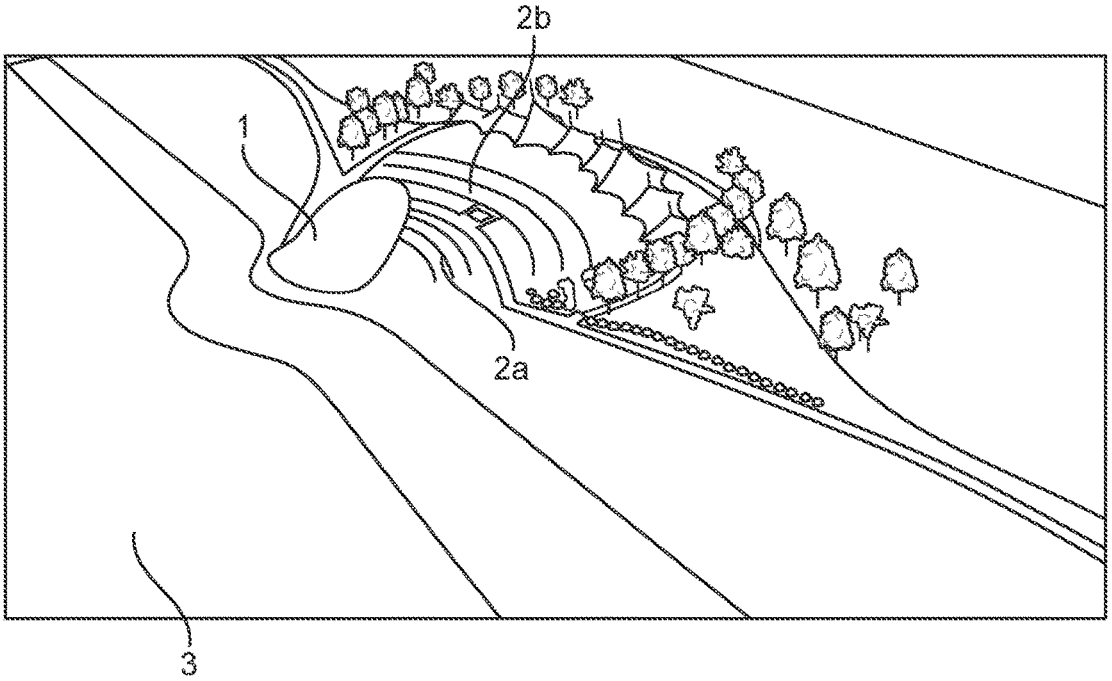
FIG. 7 shows an angle top view of an embodiment of the invention wherein the performances surface (1) is located in the perimeter of the crystal clear lagoon (3), wherein the second spectator area (2*a*) is located in front of the performances surface (1) and the second spectator area (2*b*) is directly behind the first spectator area (2*a*), wherein both spectator areas have a view of the performance surface (1) and the crystal clear lagoon (3).
Figure 8:
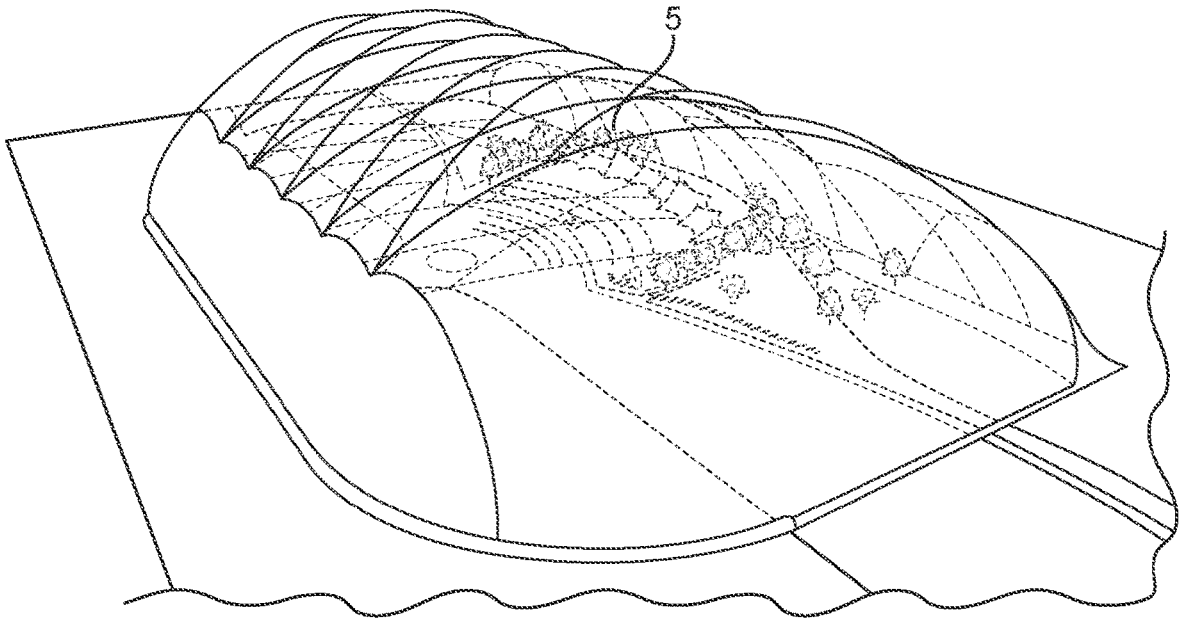
FIG. 8 shows an angle top view of an embodiment of the invention wherein the layout from FIG. 5 is protected with a dome (5) in order to allow the use of such area through different seasons, not only allowing its use for events independently of the weather, but also allowing the beach area to be used during non-event periods.
Figure 9:
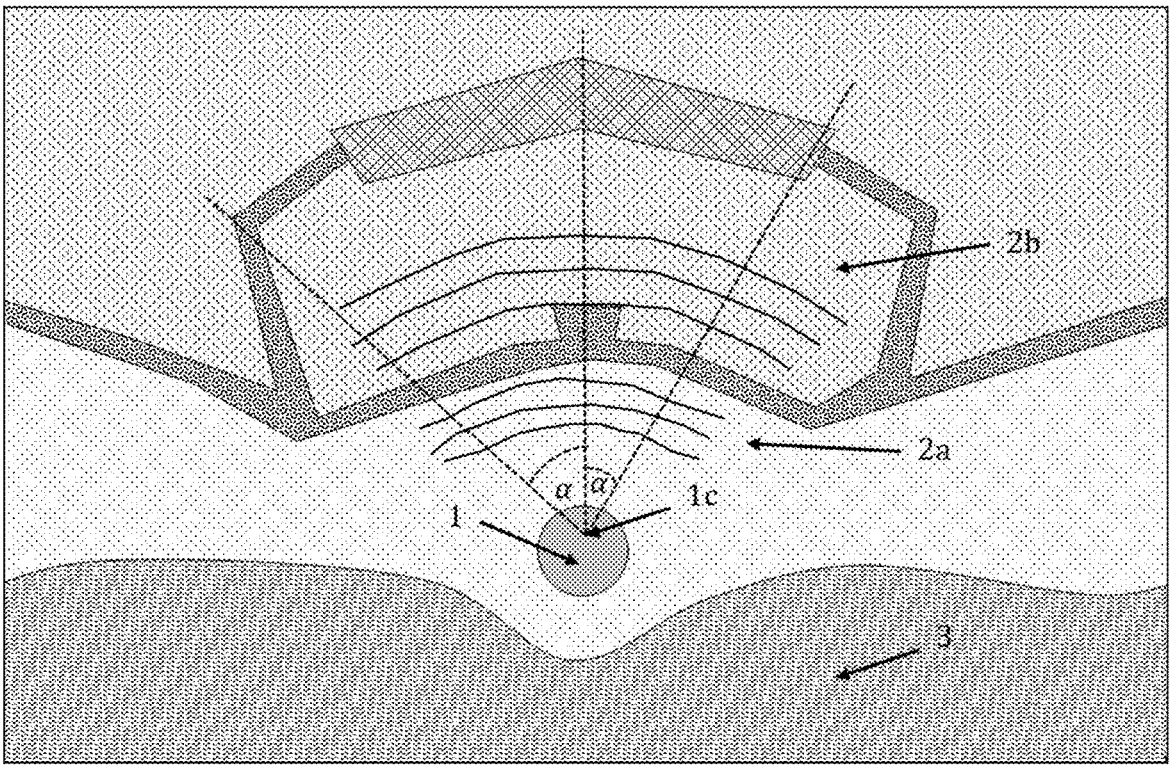
FIG. 9 shows a top view of the performance venue, including the crystal clear lagoon (3) and the performances surface (1), wherein the reference point (1*c*) located in the performance area generates a reference angle $\alpha$ for the view of the first spectator area (2*a*) and second spectator area (2*b*) of the performance surface (1).
Figure 10:
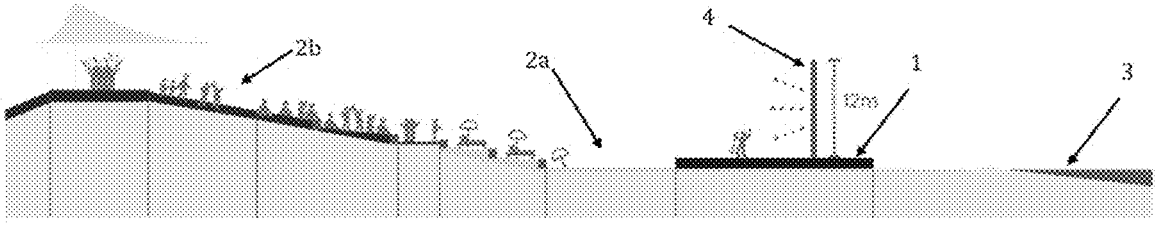
FIG. 10 shows a side view of an embodiment of the invention wherein different elevations of the first spectator area (2*a*) and second spectator area (2*b*) are seen.
Figure 11A:
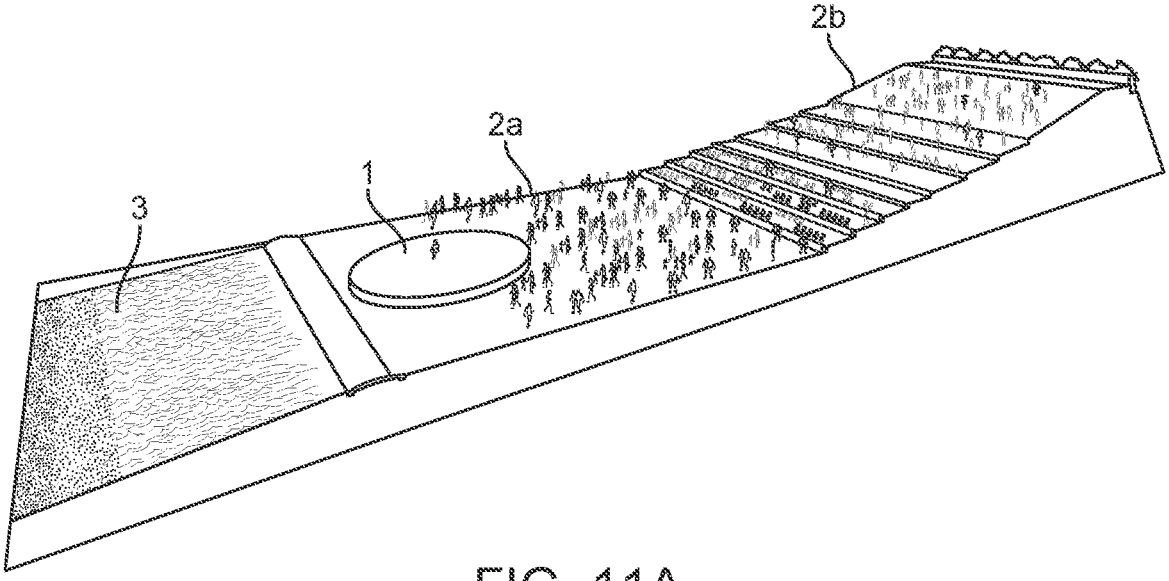
FIGS. 11A and 11B each shows an embodiment of the invention and its configuration while it's being used during an event (11A) and during non-event hours (11B).
Figure 11B:
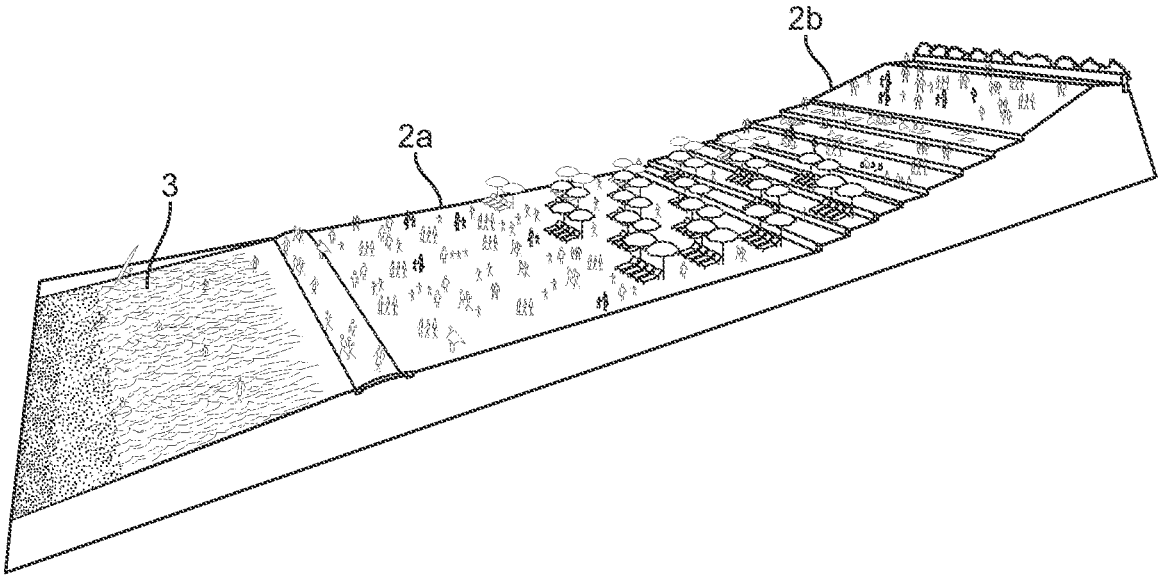

The present invention relates to an innovative urban performance venue, as seen in FIG. 5, that is configured to provide entertainment to an audience attending to an entertainment display by creating a beautiful beach themed setting with a tropical-style lagoon that surrounds the performance display and that allows to provide flexibility and extend the use and activities to be performed in such urban performance venue compared to conventional venues.

One of the objectives of the present invention is to provide a beautiful setting for holding events such as live performances and shows, creating a concept of "music on the beach" by having a beautiful tropical style crystal clear lagoon as a backdrop for a performance venue and having an ideal urban beach location with different uses and purposes such as providing beach life, allowing the practice of water sports, allowing to have waterfront walks, and providing lifestyle such as having restaurants and bars near the lagoon, provide competitions inside or outside the lagoon, providing space for other relaxation or sport activities, a gathering place for families and friends, among others. Therefore, a new concept and configuration for recreation and performances is created, by providing aesthetically pleasing views, by having sandy beach areas, and by having a spectator area design and configuration that allows proper viewing from spectators located far from the performance surface.

Therefore, the present invention discloses an innovative and new concept not existent in the market today for having "music on the beach" that provides beautiful urban beach-like settings with a backdrop crystal-clear lagoon that has sandy beaches as part of the viewing surface, and that has a specific design of the bleachers that allows people that are far away to properly watch the performance and to provide proper acoustics.

The present invention's configuration allows to provide flexible and year-round use to an innovative performance venue by generating a waterfront setting that can be used as a beach or recreational area during "dead" times where no specific events are being held, increasing flexibility of such venue. As an example, the performance venue can be used as a man-made urban beach area during the day and be compatible with events held at the same location at night, allowing to support the venue economically even though no events are held. This is very important and a game changer in this market, as if performance venues are constructed in standalone configurations, then they are not used for other purposes while there are no shows or events, however, with the present invention it is allowed to effectively use such spaces at all times and not only during shows or events.

An important advantage of the present invention is that it allows providing a performance venue in a waterfront setting like an urban beach setting, which allows providing a display of performances with a beautiful surrounding scenery as well as recreational, cultural, sports, educational, and commercial activities around it, maximizing the use of the venue even when no performance or event takes place, which generally could not be attained in closed performance venues such as indoor amphitheaters, arenas or stadiums.

The present invention discloses a performance venue for providing entertainment to an audience in a tropical style waterfront setting. The urban performance venue comprises a performances surface where the main part of the show or event is performed or showcased, and that may comprise display means arranged for optimal spectator viewing from a spectator area, wherein the spectator area allows a view of a man-made tropical style crystal clear lagoon that represents a backdrop of the performance surface with beautiful scenery and a beach themed setting.

In order to provide a comparison with current spaces used as performance venues layout and settings, the following table is shown:

TABLE 1

| Feature | Conventional spaces used for events such as stadiums and parks | Present Invention |
|---|---|---|
| Design | Spaces that do not consider holding large artistic events and performances in their primary design | Open air venue designed to hold artistic events as well as everyday use of such space like amphitheaters |
| Spectator view | Poor, lacking spectator viewing areas at different elevations with no proper view angles and closeness to the stage | Good with proper view angles and closeness to the stage, includes spectator area having different elevations |
| Use of spectator area | Only used during programmed events | Allows more permanent use by complementing with recreational or beach uses |
| Possibility of covering the venue | Not typical for open spaces like parks | Can include domes that allow year-round use and still provide beach or waterfront setting |
| Sandy Beach Setting | No | Yes as it is part of the design layout |
| Spectator Setting View with waterfront view | No | Yes, Mostly the stage and a spectacular view of a backdrop man-made crystal clear lagoon to provide waterfront setting |
| Has large event infrastructure such as proper number of bathrooms | Open spaces like parks do not have proper infrastructure | Yes as it is part of design |
| Revenues | Sporadic | More Permanent |

The urban performance venue according to the invention comprises a performances surface that may comprise a display means arranged for optimal spectator viewing from a spectator area, wherein the spectator area allows a view of a man-made crystal clear lagoon that represents a backdrop of the performance surface with beautiful scenery. The spectator area is designed so that seating or standing locations are aligned and arranged such that they provide a mostly unobstructed view of the performance surface and preferably of the display means if present, regardless of the specific location of a spectator within the venue, and also provides a good acoustics for hearing the show or performance.

Embodiments according to the invention utilize a performance venue such as an amphitheater that has a spectator area arranged at an angle overlooking the performances surface and the backdrop man-made crystal clear lagoon. The man-made crystal clear lagoon comprises a bottom, an edge and a surface configured to resemble a portion of a tropical sea, wherein the edge of the man-made crystal clear lagoon at least partially surrounds the performances surface.

The edge of the lagoon can have different configurations such as vertical walls, shallow areas, and/or a beach-type, zero entry edge that resembles a tropical style beach setting.

In a preferred embodiment of the invention, the edge of the man-made lagoon that is directly contiguous and/or that partially surrounds the performances surface is a beach-type edge that has sand and resembles the look of a tropical style beach.

The performances surface according to the invention is the area where the main show or event to be held in the performance venue generally takes place. The performances surface may include a display means that is arranged and located for optimal spectator viewing from the spectator area.

A performance venue according to the invention refers preferably to amphitheater like structures and configurations and stages of all kinds that can be adapted to any development and expected capacity that can be more formal or more flexible and multi-use, wherein the capacity of the performance venue will ultimately depend on the density desired and ranges for example, from groups of families and friends laid out on picnic blankets to seated spectators in rows within the amphitheater.

The display means according to the present invention can be any means that allows the display of entertainment, shows, and/or performances and is preferably selected from the group comprising a set, a screen, video displays, among others. Screen or stages may also be used for streaming live or recorded events or general media, and the stage zone can be used to broadcast or hold e-sport competitions, concerts, plays, shows, performances, among others.

Optimal spectator viewing according to the invention requires that a determined angle of view from the spectator area to the performances surface and additionally to the display means is achieved, allowing thus an unobstructed view of the performance surface and preferably of the display means, regardless of the specific location of a spectator within the performance venue.

The performances surface is generally located in the vicinity of a man-made crystal clear lagoon and can have various shapes and sizes. In certain embodiments of the invention, at least part of the performances surface is surrounded by the man-made crystal clear lagoon in a configuration that allows the performances surface to be embedded within the lagoon and separated from the same by an edge of the lagoon.

In other embodiments of the invention, the performances area is completely surrounded by the man-made crystal lagoon disposed as an island within the lagoon or as a floating performances surface.

In other embodiments of the invention, the performances surface is located in the vicinity of the man-made crystal clear lagoon and is not substantially attached to it. In an embodiment of the invention, the performances surface is located in a disposition such that it allows including a display means to be arranged and located for optimal spectator viewing from the spectator area.

The performances surface can have many shapes and configurations, such as a circle, square, rectangle, trapezoid, oval or any other shape and has a front side and a rear side, and includes a reference point located substantially in the center of the entertainment means. The reference point according to the invention is the point based on which the angle of view achieved from the spectator area is calculated. In a preferred embodiment, the spectators area extends over a surface that covers at least a point within at least about 30°, and more preferably at least about 60° angle of view from the reference point 1C.

The spectators area according to the invention is the area accommodates spectators that attend the entertainment display and includes at least the seating and standing locations. It is also preferably located in a surface that extends from the front side of the side of the performances surface. In some embodiments, at least part of the man-made crystal clear lagoon is located between at least a part of the front side of the side of the performances surface and the spectators area, however, in all cases the man-made crystal clear lagoon does not obstruct the spectators viewing from the spectators area to the performances surface.

As used herein, a first spectator area represents an area that is located closer to the performances surface, whereas a second spectator area represents an area that is located farther from the performances surface and its configuration preferably may change according to its use, wherein the configuration denotes preferably seating means, seating layout and attendees capacity, among others.

The spectator area comprises a first spectator area that is preferably a flat area and a second spectator area, both first and second spectator areas configured to be positioned in different elevations, wherein the highest point of the first spectator area has an elevation angle not higher than 10° with respect to the performances surface, and wherein the second spectator area has an elevation angle of at least 10°, preferably 30° with respect to the performances surface, which contributes to allow a non-obstructed view from the spectators area to the performances surface and subsequently to the entertainment means. As a distinguishable feature, the configuration of the spectator area allows the spectators to achieve a non-obstructed view not only of the performances surface and the entertainment means but also of the man-made crystal clear lagoon, which allows creating an immersive environment which is the one that enhances the experience for the spectator.

Both spectator areas can comprise seating means selected from the group comprising: standing audience platforms, seating audience platforms, chairs and combinations thereof. The second spectator area, as described before, can change its seating, layout and capacity configuration and comprises seating platforms, and in an embodiment of the invention allows a maximum average density of 4 spectators per m2.

In a very innovative manner, the spectator area according to the invention features means to accommodate spectators that attend the display of entertainment, but as a distinguishable feature, can also have alternative uses when no display of entertainment takes place or when there's no events. For instance, the spectator area, in its both first and second areas, can accommodate people who wish to sunbathe, rest o sit down in the premises of the man-made crystal clear lagoon. In another embodiment of the invention, the second spectator area can comprise tall structures and buildings that allow having a view of the performances surface.

In particular, the first spectator area according to the invention which is generally a flat area aligned with the performances surface, can comprise sand and is used as a sand beach area during non-event periods, and during event periods it can represent an area, for example, for VIP seating, among others. Preferably, the first spectator area is substantially covered with a sandy material such that a line of sight from a spectator on the second spectator area looks simultaneously at the spectator area, the display means and the man-made crystal clear lagoon to create a waterfront themed setting.

Preferably, the spectators in the first spectators area will be sitting down in the sand, which is a completely different sensation than being on hard surfaces or even sitting on grass, which provides a completely new experience for spectators of a performance.

In certain embodiments of the invention, both the first and second spectator area can be configured in a generally flat disposition which allows a larger surface to accommodate people who wish to sunbathe, rest o sit down in the premises of the man-made crystal clear lagoon.

According to the invention, a man-made crystal clear lagoon is a large water body with crystal clear waters, with a water tonality and coloration ranging from turquoise to emerald, tonalities which are naturally generated in tropical settings (i.e., near the tropics) and having depths ranges from about 0.5 meters and up to about 6 meters or higher. Such man-made crystal clear lagoons have light-colored bottoms, generally from light colored sand, wherein their depth difference creates different tonalities within the same water bodies, with clearer waters at shallower depths and more intense-colored waters at deeper depths. These tropical-style lagoons constitute the typical scenery of the Caribbean as internationally recognized and as known to the average public.

The performance venue according to the invention can be mostly outdoor, or can be fully or partially covered with domes or structures that allow year-round uses and activities in locations with strong seasonality, and that allow creating winter events inside the domes. Such domes can be structural or inflatable, and can be arranged and configured to over the complete tropical-style lagoon or a portion thereof. In such a case, the performance venue further comprises an external structure that is domed in shape that substantially covers the performance area and at least a portion of the spectator area.

The performance venue is preferably located in urban areas that can be easily reached by spectators, which refers to a type of setting and location that has road connections and access, and that is surrounded areas with a population of at least 200,000 people within a 30-mile radius.

Total seating capacity of the performance venue preferably can be from 10-10,000 people, depending on the total area dedicated to the venue space and performance surface location.

In an embodiment of the invention, the installations surrounding the tropical-style lagoon is artificially set with a nautical theme, including the use of blue and white colors with the inspiration of lighthouses and beach kiosks.

The lagoon can also be illuminated through a lighting system, in order to allow nighttime uses and provide spectacular nighttime views. The lighting system comprises exterior lighting systems and/or underwater systems.

The lagoon can also accommodate recreational waves such as surfing waves or aesthetical waves that may generate water movement.

In an embodiment of the invention, the urban performance venue can include and/or be surrounded by recreational facilities examples comprise restaurants, bars, kiosks, stores, cafes, restaurants, beach centers, promenades, hotels, entertainment facilities, virtual and immersive experiences, and similar facilities and amenities.

As part of the urban performance venue of the present invention, the following elements are included:

| # | Element |
|---|---|
| 1 | Performance Surface |
| 1a | Front side of performance surface |
| 1b | Rear side of performance surface |
| 1c | Reference point of performance surface |
| 2 | Spectator area |
| 2a | First spectator area |
| 2b | Second spectator area |
| 3 | Man-Made crystal clear lagoon |
| 3a | Bottom of lagoon |
| 3b | Edge of lagoon |
| 3c | Surface of lagoon |

-continued

| # | Element |
|---|---|
| 4 | Display Means |
| 5 | Dome |
| 6 | Swimming Pool |

Other components and methods that embody the principles of this invention can be configured within the spirit and intent of this invention. The arrangement described herein is provided as only one example of an embodiment that incorporates and practices the principles of this invention. Other modifications and alterations are well within the knowledge of those skilled in the art and are to be included within the broad scope of the appended claims.

What is claimed is:

1. An urban performance venue for the provision of entertainment to an audience in a waterfront urban beach-like themed immersive setting, wherein the venue comprises:

a structure forming a performances stage (1) arranged and configured for optimal spectator viewing from a spectator area (2), the stage (1) having a front side (la) and a rear side (1*b*), and a generally planar top surface, wherein the stage (1) includes a reference point (1*c*) located at a center point of the top surface, and wherein the stage can further include a display means (4);

the spectator area (2) comprising seating and standing locations and extending from the front side of the stage, wherein the spectator area comprises a first spectator area (2*a*) located closer to the stage and substantially covered with sand to form a tropical style beach and a second spectator area (2*b*), where the first spectator area is located between the stage and the second spectator area, and wherein each of the first and second spectator areas are positioned to form different vertical elevations with respect to the stage, the first spectator area is at a vertical elevation that is lower than the generally planar top surface of the performances stage, the first spectator area (2*a*) having an elevation angle not higher than 10° with respect to the stage reference point, and the second spectator area (2*b*) having an elevation angle of at least 30° with respect to the stage reference point, the second spectator area (2*b*) extending over a surface that covers a point within at least a 90° reference angle view from the stage reference point (1*c*) which defines the boundaries of the second spectator area (2*b*), the second spectator area having a first spectator seating portion that is flat and parallel to the generally planar top surface of the performances stage and a second spectator seating portion that is at an acute angle to the generally planar top surface of the performances stage, the first spectator seating portion is positioned between the first spectator area and the second spectator seating portion;

a man-made crystal-clear lagoon (3) extending from the rear side (1*b*) of the stage (1) in a substantially opposite direction to the spectator area (2), the man-made crystal-clear lagoon (3) having a bottom (3*a*), an edge (3*b*) and a surface (3*c*), the man-made crystal-clear lagoon arranged and configured to contain water and configured to resemble a portion of a tropical sea and suited for swimming, wherein the man-made crystal-clear lagoon (3) completely surrounds the stage such that the stage is disposed as an island within the lagoon and is non-floating, wherein the lagoon (3) has a depth of at least 0.5 meters and up to a depth of 6 meters; and wherein a line of sight from a spectator located within the second spectator area (2*b*) and from a spectator located within the first spectator area (2*a*) has views of the stage (1) and the man-made crystal-clear lagoon (3) extending behind the stage, whereby an urban beach themed performance venue and setting is created.

2. The performance venue according to claim 1, wherein the spectator area (2) extends away from the front side of the stage and begins at the edge (3*b*) of the man-made crystal-clear lagoon (3), wherein at least a portion of the man-made crystal-clear lagoon (3) lies between the spectator area (2) and the stage.

3. The performance venue according to claim 1, further comprising an external structure that substantially covers the stage (1) and at least a portion of the spectator area (2).

4. The performance venue according to claim 3, wherein the external structure is a dome.

5. The performance venue according to claim 1, wherein the second spectator represents an area that is located farther from the stage and its configuration changes according to its use, wherein the configuration is selected from the group comprising seating means, seating layout and attendee's capacity.

6. The performance venue according to claim 1, wherein the second spectator area (2*b*) comprises seating platforms.

7. The performance venue according to claim 1, wherein the second spectator area (2*b*) comprises seating means in an efficient amount to allow a maximum average density of 4 spectators per m2.

8. The performance venue according to claim 7, wherein the seating means are selected from the group comprising: standing audience platforms, seating audience platforms, chairs and combinations thereof.

9. The performance venue according to claim 1, wherein the spectator area, in its both first and second areas, can accommodate people who wish to sunbathe, rest or sit down, whereby the ambience of the man-made crystal-clear lagoon may be enjoyed.

10. The performance venue according to claim 1, wherein the surface (3*b*) of the man-made crystal-clear lagoon is of at least about 5,000 $m^2$.

11. The performance venue according to claim 1, wherein the crystal-clear lagoon (3) has different types of edges selected from the group comprising vertical walls, shallow areas and a beach-like zero entry edge that resembles a tropical beach setting.

12. The performance venue according to claim 1, wherein the edge of the man-made lagoon that is proximate to the stage is a beach-type edge that has sand and resembles the look of a tropical style beach.

13. The performance venue according to claim 1, wherein the display means is arranged and configured to display entertainment, shows, and performances and is selected from the group comprising a set, a screen, and video displays.

14. The performance venue according to claim 1, wherein the reference angle is at least 120°.

15. The performance venue according to claim 1, wherein installations surround the tropical-style lagoon and include a beach theme, including the use of blue and white colors.

16. The performance venue according to claim 1, wherein the lagoon includes a lighting system to facilitate nighttime uses and provide spectacular nighttime views.

17. The performance venue according to claim 1, wherein the lagoon accommodates recreational waves selected from the group consisting of surfing waves and aesthetical waves that generate water movement for surf.

18. The performance venue according to claim 1, wherein a conventional swimming pool is located between the edge of the lagoon and the spectator area.

19. The performance venue according to claim 1, wherein the urban performance venue includes recreational facilities selected from the group comprising restaurants, bars, kiosks, stores, cafes, restaurants, beach centers, promenades, hotels, entertainment facilities, and virtual and immersive experiences.

20. The performance venue according to claim 1, wherein the total seating capacity of the performance venue preferably is from 10-10,000 people.

21. The performance venue according to claim 1, wherein the second spectator area includes tall structures with viewing areas providing spectators with elevated views of the stage.

22. The performance venue according to claim 1, wherein the edge of the man-made crystal-clear lagoon is the perimeter of the man-made crystal-clear lagoon.

23. An urban performance venue for the provision of entertainment to an audience in a waterfront urban beach-like themed immersive setting, wherein the venue comprises:

a) a stage (1) arranged and configured for performances selected from the group consisting of musical, theatrical and sports, and wherein the stage is located for spectator viewing from a spectator area (2), the stage (1) having a front side (la) and a rear side (1*b*), and a generally planar top surface, wherein the stage (1) includes a reference point (1*c*) located at a center point of the top surface;

b) the spectator area (2) including a first spectator area (2*a*) located closer to the stage and substantially covered with sand and a second spectator area (2*b*) wherein the first spectator area is located between the stage and the second spectator area, and wherein the first and second spectator areas are arranged and configured to form different vertical elevations with respect to the stage reference point, the first spectator area is at a vertical elevation that is lower than the generally planar top surface of the stage, the first spectator area (2*a*) having an elevation angle not higher than 10° with respect to the stage reference point, and the second spectator area (2*b*) having an elevation angle of at least 30° with respect to the stage reference point, the second spectator area (2*b*) having viewing boundaries extending over a surface covering at least a 90° reference angle view from the stage reference point (1*c*), the second spectator area having a first spectator seating portion that is flat and parallel to the generally planar top surface of the stage and a second spectator seating portion that is at an acute angle to the generally planar top surface of the stage, the first spectator seating portion is positioned between the first spectator area and the second spectator seating portion;

c) a man-made crystal-clear lagoon (3) extending from the rear side (1*b*) of the stage (1) in a substantially opposite direction to the spectator area (2), the man-made crystal-clear lagoon (3) having a bottom (3*a*), an edge (3*b*) and a surface (3*c*), wherein the man-made crystal-clear lagoon (3) surrounds the stage such that the stage is disposed as an island within the lagoon and is non-floating, and wherein the lagoon is suited for swimming; and d) wherein a line of sight from a spectator located within the second spectator area (2*b*) and from a spectator located within the first spectator area (2*a*) has views of the stage (1) and the man-made crystal-clear lagoon (3) extending behind the stage, whereby an urban beach themed performance venue and setting is created.

24. The urban performance venue of claim 23, wherein the stage further includes a display.

25. The urban performance venue of claim 23, wherein the man-made crystal-clear lagoon is arranged and configured to hold clear water and the sand is a light color sand, whereby the urban venue resembles a tropical sea.

* * * * *